US009706297B2

(12) United States Patent
Chang et al.

(10) Patent No.: US 9,706,297 B2
(45) Date of Patent: Jul. 11, 2017

(54) AUDIO PROCESSING APPARATUS AND RELATED METHOD

(75) Inventors: Jung-Kuei Chang, Hsinchu Hsien (TW); Huang-Hsiang Lin, Hsinchu Hsien (TW)

(73) Assignee: MStar Semiconductor, Inc., Hsinchu Hsien (TW)

( * ) Notice: Subject to any disclaimer, the term of this patent is extended or adjusted under 35 U.S.C. 154(b) by 942 days.

(21) Appl. No.: 13/080,767

(22) Filed: Apr. 6, 2011

(65) Prior Publication Data

US 2011/0293111 A1 Dec. 1, 2011

(30) Foreign Application Priority Data

May 25, 2010 (TW) ..... 99116723 A

(51) Int. Cl.
*H04R 3/00* (2006.01)

(52) U.S. Cl.
CPC ..... *H04R 3/005* (2013.01)

(58) Field of Classification Search
CPC ..... H04S 3/02; H04S 5/02; G11B 20/00992; H04R 3/005
USPC ..... 381/97, 17–23
See application file for complete search history.

(56) References Cited

U.S. PATENT DOCUMENTS

| | | | | |
|---|---|---|---|---|
| 3,836,715 | A * | 9/1974 | Ito et al. | 381/22 |
| 5,666,424 | A * | 9/1997 | Fosgate et al. | 381/22 |
| 5,870,480 | A * | 2/1999 | Griesinger | 381/23 |
| 5,872,851 | A * | 2/1999 | Petroff | 381/18 |
| 8,488,798 | B2 * | 7/2013 | McGrath et al. | 381/22 |
| 2002/0051546 | A1 * | 5/2002 | Bizjak | H04R 3/002 381/106 |
| 2005/0175198 | A1 * | 8/2005 | Neumann | 381/312 |

FOREIGN PATENT DOCUMENTS

WO WO 2009027886 A2 * 3/2009

* cited by examiner

*Primary Examiner* — Ping Lee
(74) *Attorney, Agent, or Firm* — Edell, Shapiro & Finnan, LLC

(57) ABSTRACT

An audio processing apparatus including an audio phase detecting device and an adjusting device is provided. After detecting a phase relationship between a first channel signal and a second channel signal, the audio phase detecting device generates a phase control signal. The adjusting device is coupled to the audio phase detecting device and used for selectively adjusting the first channel signal according to the phase control signal.

16 Claims, 5 Drawing Sheets

AUDIO PROCESSING APPARATUS AND RELATED METHOD

CROSS REFERENCE TO RELATED PATENT APPLICATION

This patent application is based on Taiwan, R.O.C. patent application No. 099116723 filed on May 25, 2010.

FIELD OF THE INVENTION

The present invention relates to audio processing, and more particularly, to an audio processing apparatus for detecting and correcting audio signal errors.

BACKGROUND OF THE INVENTION

In recent years, along with the development of various electronic products, multimedia systems such as home theater systems have become more and more popular. In multimedia systems, other than screens, sound systems are the most important hardware components. Relative to mono sound systems, stereo sound systems provide presence sound effects with a plurality of speakers disposed in symmetry playing audio signals of different sound channels, respectively.

The most common stereo sound system is a binaural sound system comprising a left channel and a right channel. It is very important to keep a left channel signal and a right channel signal in the same phase, during recording or post-processing music files (e.g., during sound mixing, encoding, and decoding procedures). If, for instance, the left channel signal and the right channel signal have a 180° phase difference, playing a pleasing replication of the sound can be problematic.

In addition, in a sound system employing AGC (auto gain control) for adjusting volume, a half of a sum of the left channel signal and right channel signal is generally regarded as a basis for determining amplitude of an audio signal. That is to say, if the phase of the left channel signal differs from that of the right channel signal, a corresponding detection result of amplitude will become extremely small. In such circumstances, speakers with an AGC mechanism are likely to play at an increased volume, and thereby disrupt the hearing of listeners.

SUMMARY OF THE INVENTION

It is therefore an object of the invention to provide an audio processing apparatus and method thereof that detects the phase relationship between the left channel and the right channel, and corrects the error due to the inconformity of the phases of the left and right channel signal, before the audio signal is transmitted to the speaker for playing. The spirit of the present invention may be implemented by hardware or software, and it can be widely used in all kinds of audio players with mono or stereo sound systems.

As an embodiment of the present disclosure, an audio processing apparatus is provided; the processing apparatus comprises an audio phase detecting device and an adjusting device. The audio phase detecting device detects a phase relationship between a first audio channel signal and a second audio channel signal, for generating a phase control signal. The adjusting device is coupled to the audio phase detecting device, for selectively adjusting the first audio channel signal according to the phase control signal.

As another embodiment of the present disclosure, a method for audio processing is provided, the method comprises detecting the phase relationship between a first channel signal and a second channel signal, for generating a phase control signal. Then, the first channel signal is adjusted according to the phase control signal selectively.

The advantages and spirit related to the present invention can be further understood via the following detailed descriptions and drawings.

Following description and figures are disclosed to gain a better understanding of the advantages of the present invention.

DETAILED DESCRIPTION OF THE PREFERRED EMBODIMENT

Figure 1A:
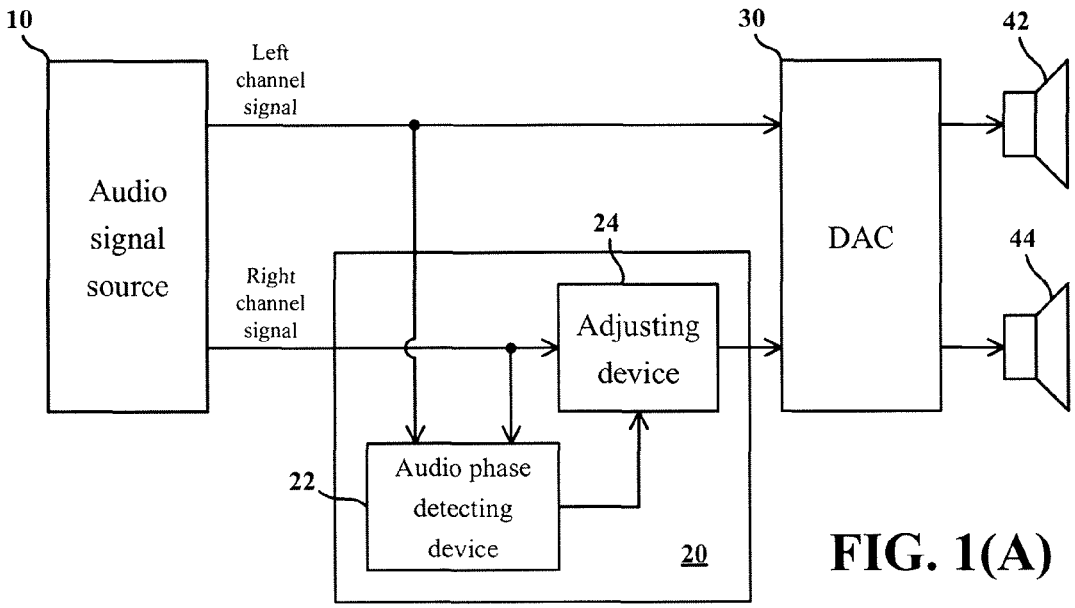
FIG. 1(A)-1(B) are schematic diagrams of an audio processing apparatus and peripheral circuits thereof according to embodiments of the present invention.

FIG. 1(A) is a schematic diagram of an audio processing apparatus 20 and peripheral circuits thereof according to an embodiment of the present invention. As shown in FIG. 1(A), an audio signal source 10 provides a left channel signal and a right channel signal, which can be PCM (pulse code modulation) signals in this embodiment, but are not limited thereto. The audio processing apparatus 20 comprises an audio phase detecting device 22 and an adjusting device 24, both coupled between the audio signal source 10 and a digital-to-analog converter (DAC) 30, which converts digital signals to analog signals. A first speaker 42 and a second speaker 44 respectively play the left channel signal and the right channel signal, both having been converted to analog signals.

The audio phase detecting device 22 detects the phase relationship between a first audio channel signal and a second audio channel signal. In the embodiment, the first audio channel signal and the second audio channel signal are the right channel signal and the left channel signal, respectively. If the phase of the right channel signal outputted from the audio signal source 10 is identical to that of the left channel signal, addition of energy of the right channel signal to the left channel signal, hereinafter an "addition energy," would be much higher than subtraction result of subtracting the left channel signal from the right channel signal, hereinafter a "subtraction energy." Hence, the audio phase detecting device 22 may deter mine whether the phase of the right channel signal is consistent with that of the left channel signal according to the relative relationship between the addition result and the subtraction result described above.

Figure 2A:
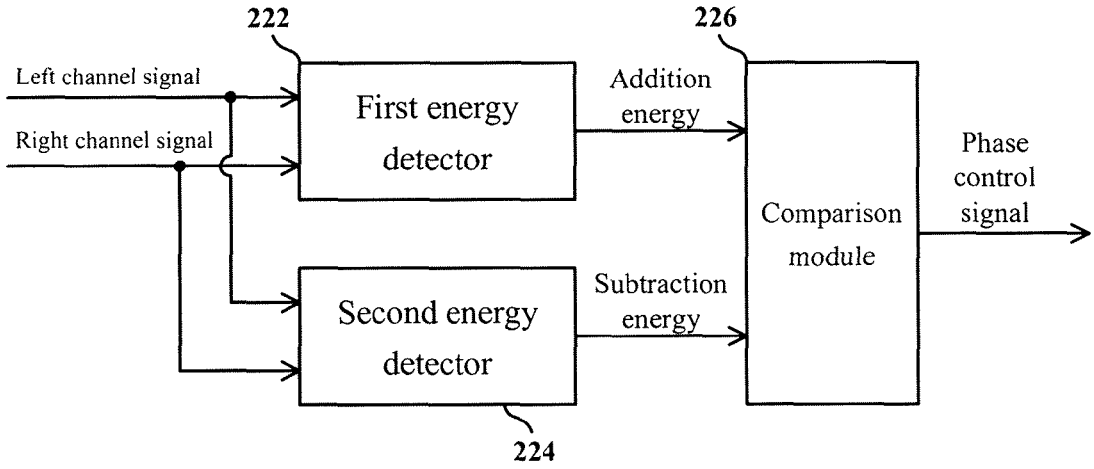
FIG. 2(A)-2(C) are detailed schematic diagrams of the audio phase detecting device in FIG. 1(A) and FIG. 1(B) according to embodiments of the present invention.

Reference is now made to FIG. 2(A), which is a detailed schematic diagram of the audio phase detecting device 22 according to an embodiment of the present invention. The audio phase detecting device 22 comprises a first energy detector 222, a second energy detector 224 and a comparison module 226. The first energy detector 222 detects energy of the addition result of adding the first channel signal to the second channel signal, i.e. the addition energy. The second energy detector 224 detects the subtraction result of subtracting the left channel signal from the right channel signal, i.e. the subtraction energy. After receiving the addition energy and the subtraction energy from the first energy detector 222 and the second energy detector 224, the comparison module 226 compares the addition energy and the subtraction energy and generates a phase control signal according to a comparison result.

If the subtraction energy is much larger than the addition energy, the comparison module 226 determines that the phase of the right channel signal and that of the left channel signal, both outputted from the audio source 10, are different. Therefore, the comparator 226 outputs a phase control signal, for requesting the adjusting device 24 to adjust the phase of one of the two channel signals. In the embodiment, the adjusting device 24 inverts the phase of the right channel signal when it is requested to adjust the phase of one of the two channel signals. In contrast, if the addition energy is higher than the subtraction energy, the comparator 226 outputs the phase control signal for requesting the adjusting device 24 not to adjust the phase of the right channel signal, and thereby the right channel signal is transmitted to the DAC 30 directly.

Figure 1B:
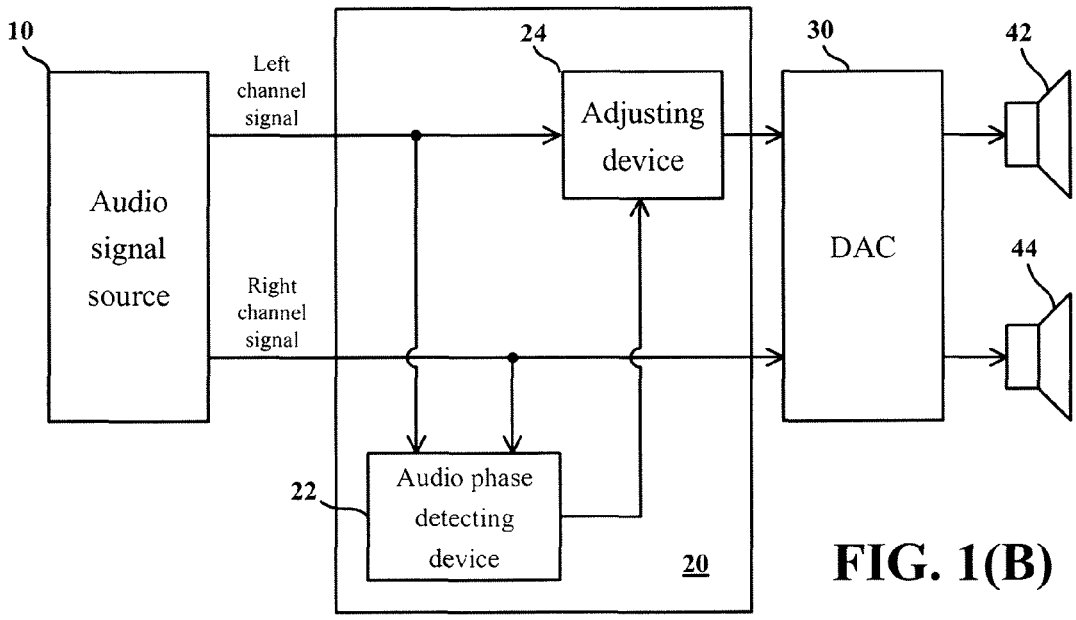

As shown in FIG. 1(B), the phase of the left channel signal can also be the one to be adjusted. By reversing the phase of one of the two channel signals, the audio processing apparatus 20 adjusts both of the channel signals to be in-phase, so as to prevent the first speaker 42 and the second speaker 44 from playing incorrect audio signals. In real applications, the audio processing apparatus 20 also can be implemented in a sound system having a single speaker, for correcting a phase error before the left channel signal and right channel signal are to be mixed and played.

Figure 2B:
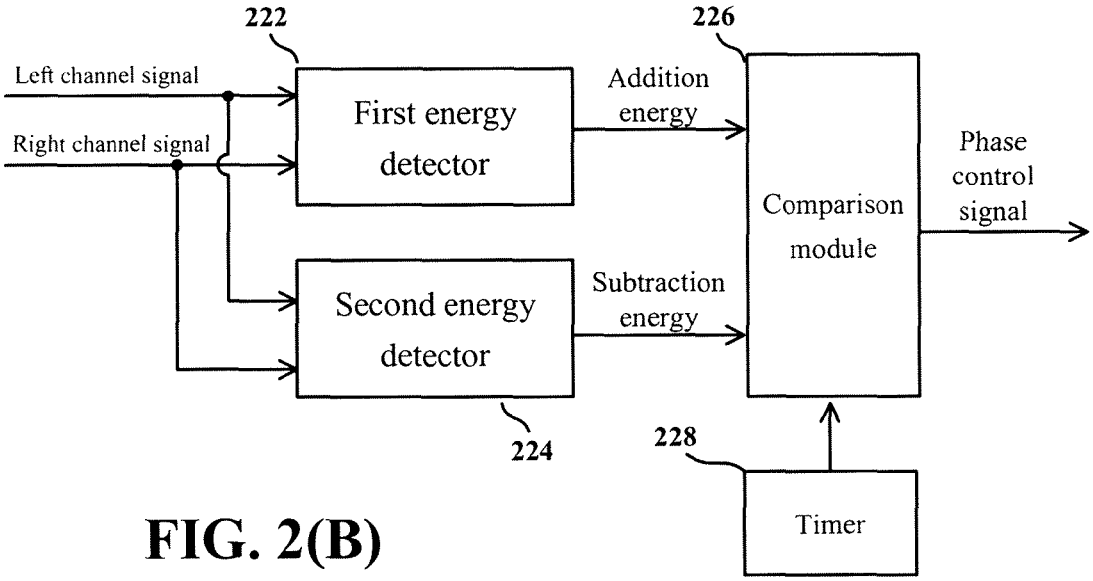

As shown in FIG. 2(B), the audio phase detecting device 22 may further comprise a timer 228, for improving an accuracy of the determination of whether the left channel signal and right channel signal have inconsistent phases. For example, the audio phase detecting device 22 can be designed to have the comparison module 226 thereof asserting the phase control signal for requesting the adjusting device 24 to adjust the right channel signal only when the subtraction energy is determined higher than the addition energy for a first predetermined time. Accordingly, the audio phase detecting apparatus 22 is capable of avoiding a misjudgment resulting from a violent, e.g., instantaneous, audio transient in the right channel signal and/or the left channel signal.

Magnitude of energy difference also provides a basis for the audio phase detecting device 22 to determine whether the two channel signals have inconformity phases. For example, the audio phase detecting device 22 can be designed to have the comparison module 226 asserting the phase control signal for requesting the adjusting device 24 to adjust the right channel signal only when the subtraction energy exceeds the addition energy by a first threshold for the first predetermined time.

The audio signal source 10 may be designed to continuously output signals corresponding to a plurality of different music files. Among these music files, it is possible that not all of the music files have a phase inconformity problem between the left and right channel signals, while it is also possible that only a part of data in one music file has such a phase inconformity problem. Preferably, the audio phase detecting device 22 monitors a phase relationship between the left channel signal and the right channel signal continuously, and requests the adjusting device 24 to stop adjusting when it discovers that the phase of the left and right channel signal provided by the audio source 10 becomes conformed.

In connection with the timer 228 described above, the audio phase detecting device 22 can be configured to request that the adjusting device 24 stop adjusting the right channel signal when the subtraction energy is lower than the addition energy for a second predetermined time, which is counted by the timer 228, after the adjusting device 24 has begun to adjust the right channel signal. Alternatively, the audio phase detecting device 22 may be designed to request the adjusting device 24 to stop adjusting the right channel signal when the subtraction energy is lower than the addition energy for a second threshold for the second predetermined time, after the adjusting device 24 has begun to adjust the right channel signal. The second threshold is not necessarily equal to the first threshold, and the second predetermined time is also not necessarily equal to the said first predetermined time.

Figure 2C:
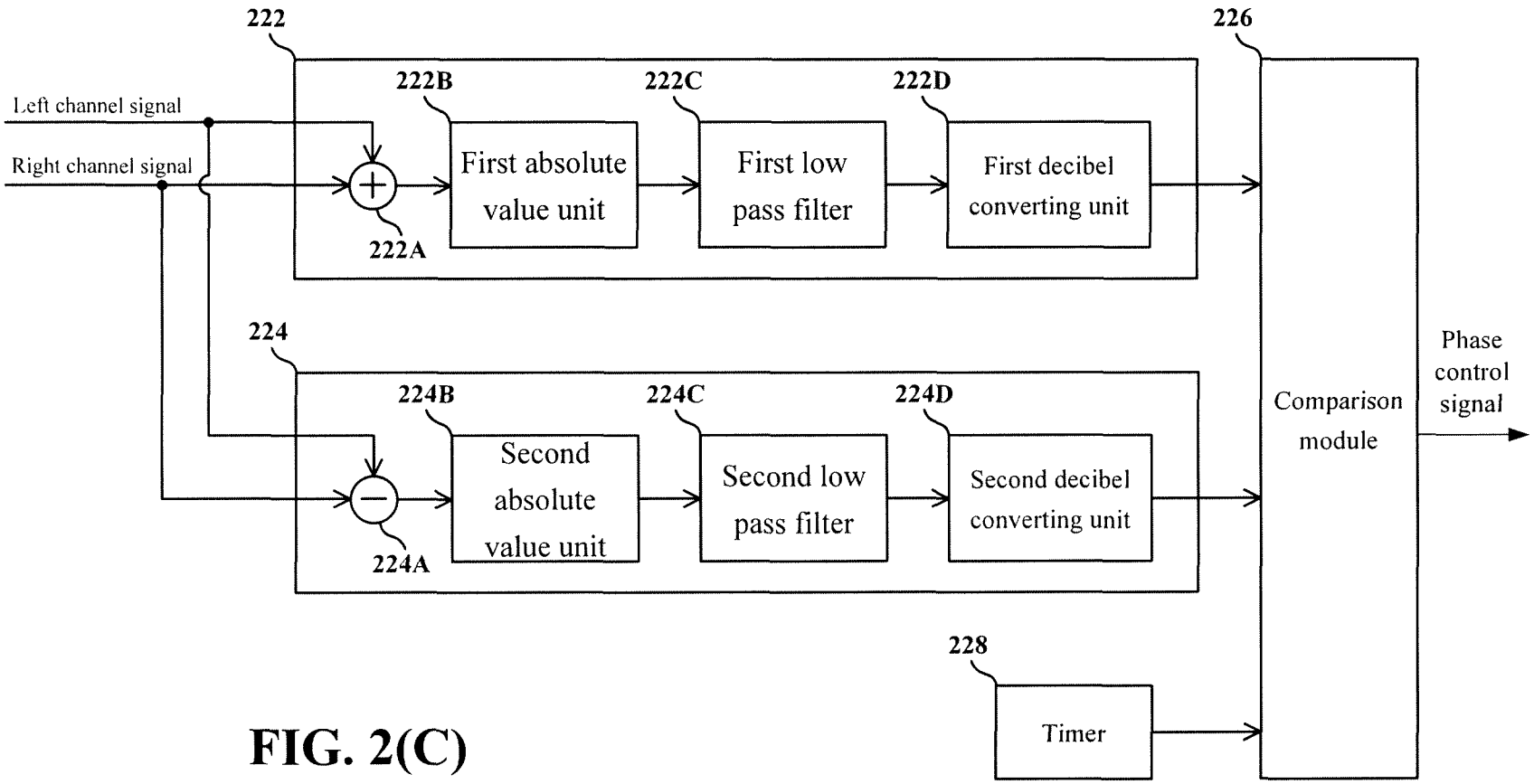

Reference is now made to FIG. 2(C), which is a detailed schematic diagram of the audio phase detecting device 22 according to an embodiment of the present invention. The first energy detector 222 comprises an adder 222A, and a first absolute value unit 222B, a first low pass filter 222C and a first decibel converting unit 222D. The adder 222A adds the left channel signal to the right channel signal to generate an addition signal. The first absolute value unit 222B generates a first absolute signal corresponding to the addition signal, representing the addition energy of the audio signal. The first low-pass filter 222C filters out the high-frequency noise from the absolute signal to generate a first filtering result. The first decibel converting unit 222D converts the filtered addition energy to be in the unit of decibel, so as to facilitate processing.

As shown in FIG. 2(C), the second energy detector 224 comprises a subtractor 224A, a second absolute value unit 224B, a second low pass filter 224C, and a second decibel converting unit 224D. The subtractor 224A subtracts the right channel signal from the left channel signal to generate a subtraction signal. The second absolute value unit 224B generates a second absolute signal corresponding to the subtraction signal, representing the subtraction energy of the audio signal. The second low pass filter 224C filters out the high-frequency noise from the second absolute signal to generate a second filtering result value. The second decibel converting unit 224D converts the filtered subtraction energy to be in the unit of decibel, so as to facilitate, in the comparison module 226, comparing the addition energy and the subtraction energy in the unit of decibel.

Figure 3:
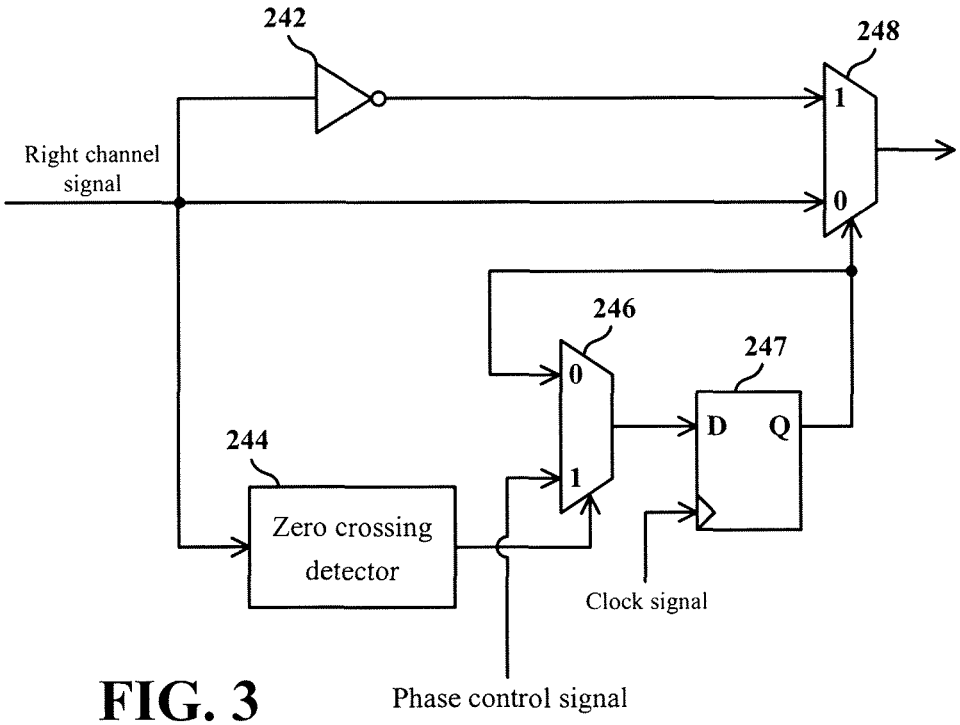
FIG. 3 is detailed schematic diagram of the audio phase detecting device in FIG. 1(A) and FIG. 1(B) according to an embodiment of the present invention.

Reference is now made to FIG. 3, which is a detailed schematic diagram of the adjusting device 24 according to an embodiment of the present disclosure. The adjusting device 24 comprises a phase inverter 242, a zero crossing detector 244, a first multiplexer 246, a flip-flop 247 and a second multiplexer 248. A state of an output signal of the flip-flop 247 is related to both of a clock signal CK and an output signal of the first multiplexer 246. When the output signal of the flip-flop 247 is at a low level, the second multiplexer 248 will select the unadjusted right channel signal as the output signal. On the contrary, when the output signal of the flip-flop 247 is at a high level, the second multiplexer 248 will select the adjusted right channel signal adjusted by the phase inverter 242 as the output signal.

The zero-crossing detector 244 is capable of selecting a preferable switching point for the second multiplexer 248 to switch the output signal. The zero-crossing detector 244 determines whether the right channel signal meets a low amplitude requirement, for example, whether the amplitude of the right channel signal is within a specific threshold range. Only when the right channel signal meets the low amplitude requirement, can the zero crossing detector 244 switch the output voltage to the high level, allowing the phase control signal provided by the audio phase detecting device 22 to be transmitted to the flip-flop 247, and thereby influence the output signal of the second multiplexer 248. Accordingly, unpleasant noise generated by the speaker 44, resulting from a sudden switch of the signals by the adjusting device 24 in a relatively high volume situation, can be avoided.

Figure 4A:
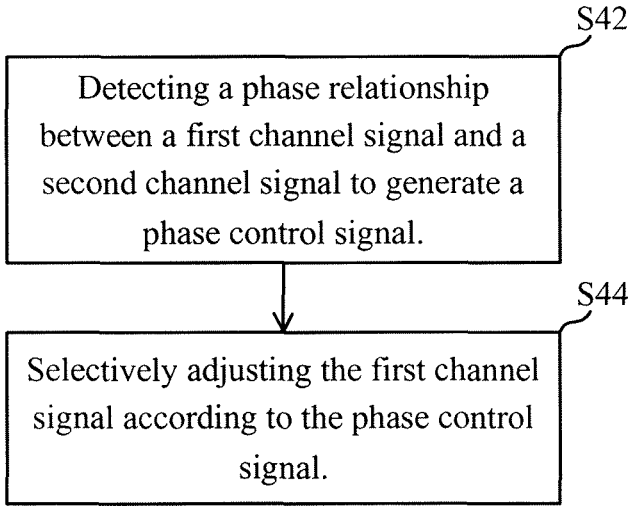
FIG. 4(A) and FIG. 4(B) are flowcharts of audio processing methods according to embodiments of the present invention.

FIG. 4(A) shows a flowchart of an audio processing method according to an embodiment of the present invention. Step S42 comprises detecting a phase relationship between a first channel signal and a second channel signal to generate a phase control signal. Subsequently, step S44 comprises selectively adjusting the first channel signal according to the phase control signal.

Figure 4B:
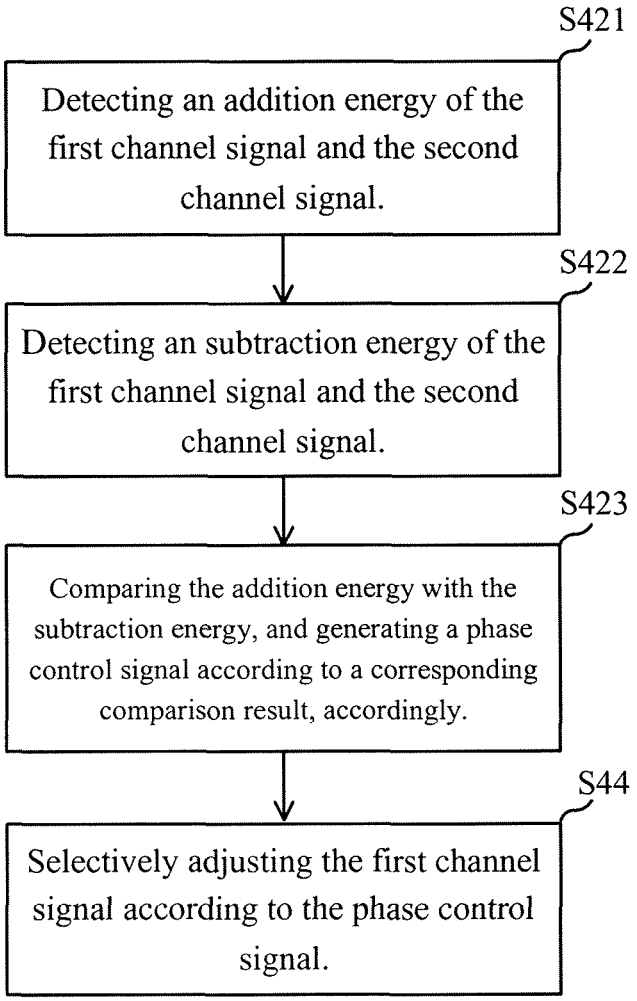

FIG. 4(B) further illustrates a flowchart of a method for detecting the phase relationship between the first channel signal and the second channel signal according to an embodiment of the present invention. Step S421 provides for detecting an addition energy of the first channel signal and the second channel signal is performed. Step 422 comprises detecting subtraction energy of the first channel signal and the second channel signal is performed. Step S423 follows by comparing the addition energy with the subtraction energy, and generating a phase control signal according to a comparison result, accordingly. Then, step S44, as in FIG. 4(A) selectively adjusts the first channel signal according to the phase control signal.

As mentioned above, an audio processing apparatus and related method are provided, before the audio signal is transmitted to the speaker(s) for playing, detecting the phase relationship between the left and right channel signal, and automatically correcting a phase inconformity error. Thereby, many problems caused by phase inconformity between the left channel signal and the right channel signal can be avoided effectively. The essence of the present invention may be implemented by hardware or software, and can be widely used in all kinds of audio players with mono or stereo sound systems.

While the invention has been described in terms of what is presently considered to be the most practical and preferred embodiments, it is to be understood that the invention needs not to be limited to the above embodiments. On the contrary, it is intended to cover various modifications and similar arrangements included within the spirit and scope of the appended claims which are to be accorded with the broadest interpretation so as to encompass all such modifications and similar structures.

What is claimed is:

1. An audio processing apparatus, comprising:

an audio phase detecting device, for detecting a phase relationship between a first channel signal and a second channel signal, to generate a phase control signal; and an adjusting device, coupled to the audio phase detecting device, for adjusting a phase of only the first channel signal according to the phase control signal and for correcting a phase inconformity between the first channel signal and the second channel signal by applying a 180 degree phase shift to the first channel signal regardless of a frequency of the first channel signal, wherein the audio phase detecting device comprises:

a first energy detector, for detecting an addition energy of the first channel signal and the second channel signal;

a second energy detector, for detecting a subtraction energy of the first channel signal and the second channel signal; and a comparison module, for comparing the addition energy with the subtraction energy to generate the phase control signal, and wherein the adjusting device comprises a zero crossing detector for determining whether only the first channel signal meets a low amplitude requirement, and the adjusting device adjusts the first channel signal when the first channel signal meets the low amplitude requirement.

2. The audio processing apparatus of claim 1, wherein the comparison module deasserts the phase control signal for requesting the adjusting device to stop adjusting the first channel signal when the subtraction energy is below the addition energy by a first threshold for a first predetermined time.

3. The audio processing apparatus of claim 1, wherein the comparison module asserts the phase control signal for requesting the adjusting device to adjust the first channel signal when the subtraction energy is higher than the addition energy for a second predetermined time.

4. The audio processing apparatus of claim 1, wherein the comparison module asserts the phase control signal for requesting the adjusting device to adjust the first channel signal when the subtraction energy exceeds the addition energy by a second threshold for a second predetermined time.

5. The audio processing apparatus of claim 1, wherein the first energy detector comprises:

an adder, for adding the first channel signal to the second channel signal to generate an addition signal;

an absolute value unit, for generating a first absolute signal corresponding to the addition signal;

a first low pass filter, for filtering the first absolute signal to generate a first filtering result; and a first decibel converting unit, for converting the first filtering result to an addition energy in a unit of decibel.

6. The audio processing apparatus of claim 1, wherein the second energy detector comprises:

a subtractor, for subtracting the second channel signal from the first channel signal to generate a subtraction signal;

a second absolute value unit, for generating a second absolute signal corresponding to the subtraction signal;

a second low pass filter, for filtering the second absolute signal to generate a second filtering result; and a second decibel converting unit, for converting the second filtering result to a subtraction energy in a unit of decibel.

7. The audio processing apparatus of claim 1, wherein the adjusting device selectively inverts the phase of the first channel signal.

8. The audio processing device of claim 1, wherein the audio phase detecting device further comprises a timer, coupled to the comparison module, wherein the comparison module deasserts the phase control signal for requesting the adjusting device to stop adjusting the first channel signal when the subtraction energy is lower than the addition energy for a first predetermined time.

9. An audio processing method, comprising:

detecting a phase relationship between a first channel signal and a second channel signal to generate a phase control signal; and adjusting a phase of only the first channel signal according to the phase control signal to correct a phase inconformity between the first channel signal and the second channel signal by applying a 180 degree phase shift to the first channel signal regardless of a frequency of the first channel signal, wherein the step of detecting the phase relationship comprises:

(a1) detecting an addition energy of the first channel signal and the second channel signal;

(a2) detecting a subtraction energy of the first channel signal and the second channel signal; and (a3) comparing the addition energy with the subtraction energy to generate the phase control signal, wherein the step of adjusting the first channel signal comprises:

when the first channel signal meets a low amplitude requirement according to a zero crossing detector, adjusting the first channel signal.

10. The audio processing method of claim 9, wherein the step (a3) further comprises:

when the subtraction energy is below the addition energy by a first threshold for a first predetermined time, deasserting the phase control signal for requesting to stop adjusting the first channel signal.

11. The audio processing method of claim 9, wherein the step (a3) further comprises:

when the subtraction energy is higher than the addition energy for a second predetermined time, asserting the phase control signal for requesting to adjust the first channel signal.

12. The audio processing method of claim 9, wherein the step (a3) further comprises:

when the subtraction energy exceeds the addition energy by a second threshold for a second predetermined time, asserting the phase control signal for requesting to adjust the first channel signal.

13. The audio processing method of claim 9, wherein the step (a1) further comprises:

adding the first channel signal to the second channel signal, for generating an addition signal;

generating a first absolute value signal corresponding to the addition signal;

filtering the first absolute value signal to generate a first filtering result value; and converting the first filtering result value to an addition energy value in a unit of decibel.

14. The audio processing method of claim 9, wherein the step (a2) further comprises:

subtracting the second channel signal from the first channel signal to generate a subtraction signal;

generating a second absolute value signal corresponding to the subtraction signal;

filtering the second absolute value signal to generate a second filtering result value; and converting the second filtering result value to a subtraction energy in a unit of decibel.

15. The audio processing method of claim 9, wherein the step of adjusting the first channel signal comprises selectively reversing the phase of the first channel signal.

16. The audio processing method of claim 9, wherein the step (a3) further comprises:

when the subtraction energy is lower than the addition energy for a first predetermined time, deasserting the phase control signal for requesting to stop adjusting the first channel signal.

* * * * *